US008196763B2

(12) United States Patent
Greenberg

(10) Patent No.: US 8,196,763 B2
(45) Date of Patent: Jun. 12, 2012

(54) STRAW HOLDER INTEGRATED WITH A BEVERAGE CONTAINER

(75) Inventor: Alex M. Greenberg, New York, NY (US)

(73) Assignee: Greenberg Surgical Technologies, LLC, New York, NY (US)

( * ) Notice: Subject to any disclaimer, the term of this patent is extended or adjusted under 35 U.S.C. 154(b) by 1166 days.

(21) Appl. No.: 11/899,646

(22) Filed: Sep. 7, 2007

(65) Prior Publication Data

US 2008/0006600 A1 Jan. 10, 2008

Related U.S. Application Data

(63) Continuation-in-part of application No. 10/888,681, filed on Jul. 9, 2004, which is a continuation-in-part of application No. 10/684,882, filed on Oct. 14, 2003.

(51) Int. Cl.
*B65D 47/04* (2006.01)
*A47G 19/22* (2006.01)
*G09F 3/00* (2006.01)

(52) U.S. Cl. ..... 215/229; 40/310; 220/709; 206/831

(58) Field of Classification Search ..... 215/366–388, 215/228, 395, 399; 220/705, 707, 709, 710, 220/212; 40/310; 248/682, 317; 229/89, 229/404; 239/33
See application file for complete search history.

(56) References Cited

U.S. PATENT DOCUMENTS

| | | | |
|---|---|---|---|
| 103,300 | A | 5/1870 | Chapin |
| 134,302 | A | 12/1872 | Miller |
| 447,635 | A | 3/1891 | Day |
| 571,088 | A | 11/1896 | Hamilton |
| 811,742 | A | 2/1906 | Petrie |
| 947,098 | A | 1/1910 | Ellis |
| 1,962,883 | A | 8/1932 | Tate et al. |
| 2,070,495 | A | 4/1935 | Strutz et al. |
| 2,112,477 | A | 3/1938 | Brownfield |
| 2,378,660 | A | 5/1944 | Roux |
| 3,063,590 | A | 7/1961 | Hopkins |
| 3,438,527 | A | 4/1969 | Gamblin, Jr. |

(Continued)

FOREIGN PATENT DOCUMENTS

| | | | |
|---|---|---|---|
| JP | 8-72845 | A | 3/1966 |
| JP | 2003-212264 | | 7/2003 |

(Continued)

OTHER PUBLICATIONS

International Search Report and Written Opinion dated May 11, 2007 issued in corresponding application No. PCT/US04/32903.

(Continued)

*Primary Examiner* — Robin Hylton
(74) *Attorney, Agent, or Firm* — Cozen O'Connor

(57) ABSTRACT

A beverage container having a mouth includes a straw holder having a straw support portion dimensioned for placement across the mouth of the container and comprising an aperture designed to receive a straw therethrough and support the straw with respect to the straw support portion. A first retaining portion of the straw holder is connected to the straw support portion and connected or connectable to the container. The straw support portion being movably arranged on the first connecting portion for moving from a first position to a second position relative to the first retaining portion. The aperture for receiving the straw is aligned with the mouth of the container when the first connecting portion is in a connected position on the container.

12 Claims, 16 Drawing Sheets

U.S. PATENT DOCUMENTS

| | | | | |
|---|---|---|---|---|
| 3,606,156 | A | 9/1971 | Homorodean, Jr. et al. | |
| 3,822,030 | A | 7/1974 | Tanzer | |
| 4,909,437 | A | 3/1990 | Kang | |
| 5,160,058 | A | 11/1992 | Ahn | |
| 5,671,863 | A | 9/1997 | Uliana | |
| 5,676,306 | A * | 10/1997 | Lankin et al. | 229/404 |
| 5,720,412 | A | 2/1998 | Ficken | |
| 5,823,493 | A | 10/1998 | Eastland, Jr. et al. | |
| 6,149,111 | A | 11/2000 | Epstein | |
| 6,299,014 | B1 | 10/2001 | Nava et al. | |
| 6,325,247 | B1 | 12/2001 | Iggulden | |
| 6,601,728 | B1 * | 8/2003 | Newkirk et al. | 220/739 |
| 6,703,216 | B2 | 3/2004 | Parsons et al. | |
| 6,955,289 | B2 * | 10/2005 | Green | 229/128 |
| 7,100,787 | B2 | 9/2006 | Farnsworth | |
| 7,419,067 | B2 * | 9/2008 | Bouie et al. | 220/379 |
| 2003/0044989 | A1 | 3/2003 | Guerra et al. | |
| 2004/0146429 | A1 | 7/2004 | Guerra et al. | |
| 2005/0029270 | A1 | 2/2005 | Marshall | |

FOREIGN PATENT DOCUMENTS

| | | |
|---|---|---|
| WO | WO 99/65782 | 12/1999 |

OTHER PUBLICATIONS

Computer generated English translation of JP 8-72845.

* cited by examiner

STRAW HOLDER INTEGRATED WITH A BEVERAGE CONTAINER

CROSS-REFERENCE TO RELATED APPLICATIONS

The present application is a Continuation-in-Part of U.S. application Ser. No. 10/888,681 filed Jul. 9, 2004, which is a Continuation-in-Part of U.S. application Ser. No. 10/684,882, filed Oct. 14, 2003. The entire contents of U.S. application Ser. Nos. 10/888,681 and 10/684,882 are incorporated herein by reference.

BACKGROUND OF THE INVENTION

The invention relates to a straw holder/beverage protector for vertically supporting and orienting a drinking straw in the mouth of a bottle or can and/or covering the mouth of the bottle or can to protect the beverage from spillage and inadvertent or intentional contamination.

Consumers of beverages may prefer to drink directly from a bottle through a straw. Dental research has shown that consumption of beverages with a straw allows the beverage to bypass a consumer's teeth which reduces tooth decay, erosion, and staining. In addition to this medical advantage, there are further reasons for drinking out of a straw. While driving a car, for example, bottled liquid is less subject to spillage, but tipping up the bottle for a drink interrupts a driver's view of the road. Use of a straw with a bottle addresses both the spillage and safety issues, but presents a problem when a too-short straw falls into a too-long bottle. In addition, carbon dioxide bubbles from a carbonated beverage may accumulate on the straw and cause it to rise out of the bottle. It would, therefore, be desirable to support the straw vertically in the bottle so that it cannot fall in or rise out. At the same time, it would be desirable to stabilize the angular position of the straw so that it cannot rotate within the mouth of the bottle. A device addressing this problem could also be used by invalids who may not have full use of their hands.

Another problem associated with open beverages is contamination of the beverage therein by the ingress of contaminants through the mouth of the bottle or can. For example, dirt or other air-borne debris may enter the bottle or can through the mouth resulting in an unpleasant experience for the intended user. More seriously, the contamination may be a bee which flies into the beverage or harmful contaminants such as, for example, date rape drugs. The straw holder/beverage protector which covers the mouth of the bottle or can will prevent or at least reduce the likelihood of the addition of contaminants to a beverage.

Still another problem associated with bottled beverages is drips which run down the side of the bottle after the beverage is poured. This problem is especially pronounced when the beverage is a dark colored beverage such as red wine which can stain an underlying surface.

Accordingly, there is a need for straw holder and/or beverage/drip protector which is readily available and easy to use. To make the straw holder available when needed, the straw holder could be incorporated with the packaging on a bottle or can.

BRIEF SUMMARY OF THE INVENTION

An object of the present invention is to provide an improved straw holder and/or beverage/drip protector which overcomes the problems of the prior art.

The object is met by a beverage container having a mouth and a straw holder having a straw support portion dimensioned for placement across the mouth of the container and comprising an aperture designed to receive a straw therethrough and support the straw with respect to the straw support portion. A first retaining portion of the straw holder is connected to the straw holding portion and connected or connectable to the container. The straw holding portion being movably arranged on the first connecting portion for moving from a first position to a second position relative to the first retaining portion. The aperture for receiving the straw is aligned with the mouth of the container when the first connecting portion is in a connected position on the container.

The straw holder may further comprise a second retaining portion connected to one of the container and the straw holder, the straw holding portion having a free end connectable to the second retaining portion for holding the straw holding portion in the second position. According to one embodiment, the first retaining portion is a collar connected or connectable to the container proximate the mouth of the container. The second retaining portion is arranged on said collar.

According to a further embodiment, the container is a bottle and the collar comprises a collar of a plastic cap of the bottle which remains on the bottle when the cap is removed.

The straw holder may be made of a flexible sheet material. The straw holder may comprise a part of a label encircling the bottle. Alternatively, the straw holder may be arranged under a label encircling the bottle. A second retaining portion may be arranged on the label, the straw holding portion having a free end connectable to the second retaining portion for holding the straw holding portion in the second position.

The straw support portion is preferably arranged so that it is proximate a side of the beverage container in the first position, thereby allowing transport and handling of the beverage container prior to opening of the mouth. For this purpose, a free end of said straw support portion may be held against the container by a label encircling the container prior to use of the container. Alternatively, a shrink wrap plastic is placed over at least a portion of said straw holder and holds said straw holder prior to use of the container. The straw support portion being proximate the mouth in the second position so that the straw holder vertically supports a straw through the aperture and in the mouth of the beverage container.

If the container is a can, the straw holding portion may have a free end connectable to a tab on the can for holding the straw holding portion in the second position. Furthermore, the straw holder may be arranged under a cover on the top of the can, which is removed prior to opening the can.

The object is also met by a straw holder mountable on a container for holding a straw relative to the container, the straw holder including a straw support portion dimensioned for placement across the mouth of the container and having a first aperture designed to receive the straw therethrough and support the straw with respect to said straw support portion. The straw holder also includes a first retaining portion connected to the straw holder for interacting with the container, the first retaining portion being configured to hold the straw support portion relative to the container.

The first retaining portion may comprise a second aperture for receiving a portion of the container. For example, the first retaining portion may comprise a ring which fits around a portion of the container. Furthermore, an ad area having a space for displaying an ad may be connected to the first retaining portion.

The first retaining portion may comprise tabs bendable out of the plane of the straw holder and arrangable so that they are held against an inner side of the opening of the container.

The straw holder may be slidable in a recess defined in the first retaining portion for moving between first and second positions. The first retaining portion may comprise a thermal insulating sleeve for receiving the container, wherein the recess is defined in the sleeve.

The straw holder may be part of a package in which the container is sold.

The straw holder may be a cover comprising a removable portion for access therethrough.

The straw holder may include a stopper receivable by an interference fit in the mouth of the container for closing the container.

The straw holder may be releasably connected to a cup sleeve.

The straw holder may include a straw extender which receives the end of a straw and has a tubular portion extending the length of the straw.

The object of the present invention is also met by a beverage drip protector having a support layer defining a first hole for receiving a neck of a beverage container therethrough, and an absorbent layer arranged on the support layer and covering the first hole. The absorbent layer has slits in the area of the first hole allowing the neck of the beverage container to extend therethrough such that the absorbent layer rests against the sides of the neck to absorb drips. The support layer further includes either a second hole dimensioned and arranged for receiving a cap of the beverage container or a detachable ad area displaying an advertisement or a label. The ad area may be connected to the support by perforations for easy removal. The second hole may be dimensioned for holding the cork of a wine bottle or other beverage cap.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
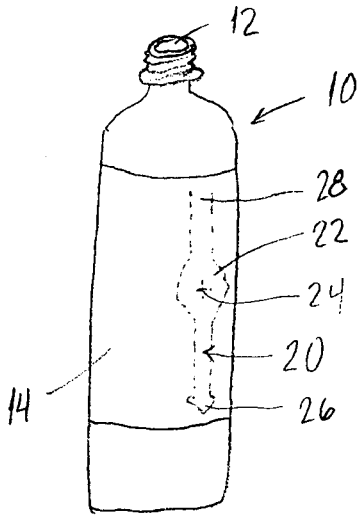
FIG. 1 is a side perspective view of a bottle including straw support according to a first embodiment of the present invention in which an outer cover is partially removed.

FIG. 1 depicts a bottle 10 incorporating a straw holder 20. The bottle 10 includes a band 14 made of a film or thin sheet of material wrapped around the bottle. The band may, for example, be a label of the bottle. Although the bottle is depicted as being cylindrical, the bottle can have any shape. Perforations in the band 14 define the straw holder 20, which includes a straw support portion 22 having a central aperture 24 dimensioned to receive a straw therethrough in an interference fit. As shown in FIG. 1, the aperture 24 may be formed by crossed slits which form bendable tabs. The straw support 20 includes a first end 26 and a second end 28. To use the straw holder a user separates the first end 26 and the straw support portion 22 from the label along the perforations. There are no perforations at the second end 28. Accordingly, the straw holder 20 remains connected during use to the band 14 and thus to the bottle 10. After separation of the straw support portion 22 from the band 14, the user positions the aperture 24 over the mouth of the bottle so that the straw can be inserted through the aperture and into the mouth of the bottle. The straw holder 20 should be large enough to completely cover the opening in the mouth of the bottle. This will prevent contaminants, such as date rape drugs, from falling or being placed into the bottle and also prevents insects such as bees from entering the bottle during use.

Figure 2:
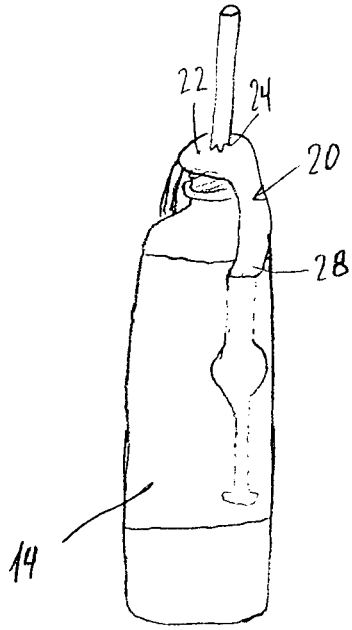
FIG. 2 is a side perspective view the bottle of FIG. 1 in which the straw support is arranged in its position for use.
Figure 3:
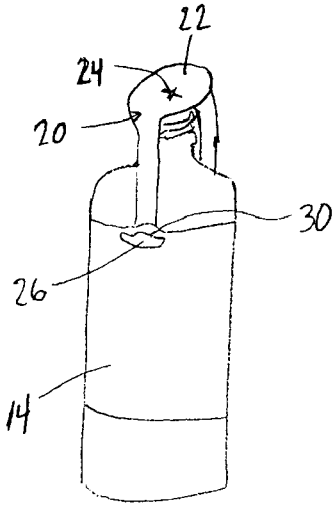
FIG. 3 is a side perspective view showing the rear side of the bottle of FIG. 2.

FIG. 2 shows the bottle 10 of FIG. 1 after the straw holder has been separated from the band 14. FIG. 3 shows a rear view of the bottle 10 shown in FIG. 2. As shown in FIG. 3, the first end 26 of the straw holder 20 is brought over the top of the mouth of the bottle and inserted in a slit 30 in the band 14 for holding the straw support portion 22 in a position over the mouth of the bottle. Alternatively, the straw may be used to hold the straw support portion 22 in place over the mouth of the bottle without using the first end 26. In this case, the straw support portion 22 is held over the mouth by the user while the straw is inserted through the aperture 24. Once the straw is fully inserted in the bottle, the interference between the straw and the interior of the bottle prevents the straw holder from moving from the position over the mouth of the bottle. In one embodiment, the straw support portion may be made of a plastic wrap material such as Saran wrap which is held onto the top of the bottle without the use of an adhesive.

Figure 1A:
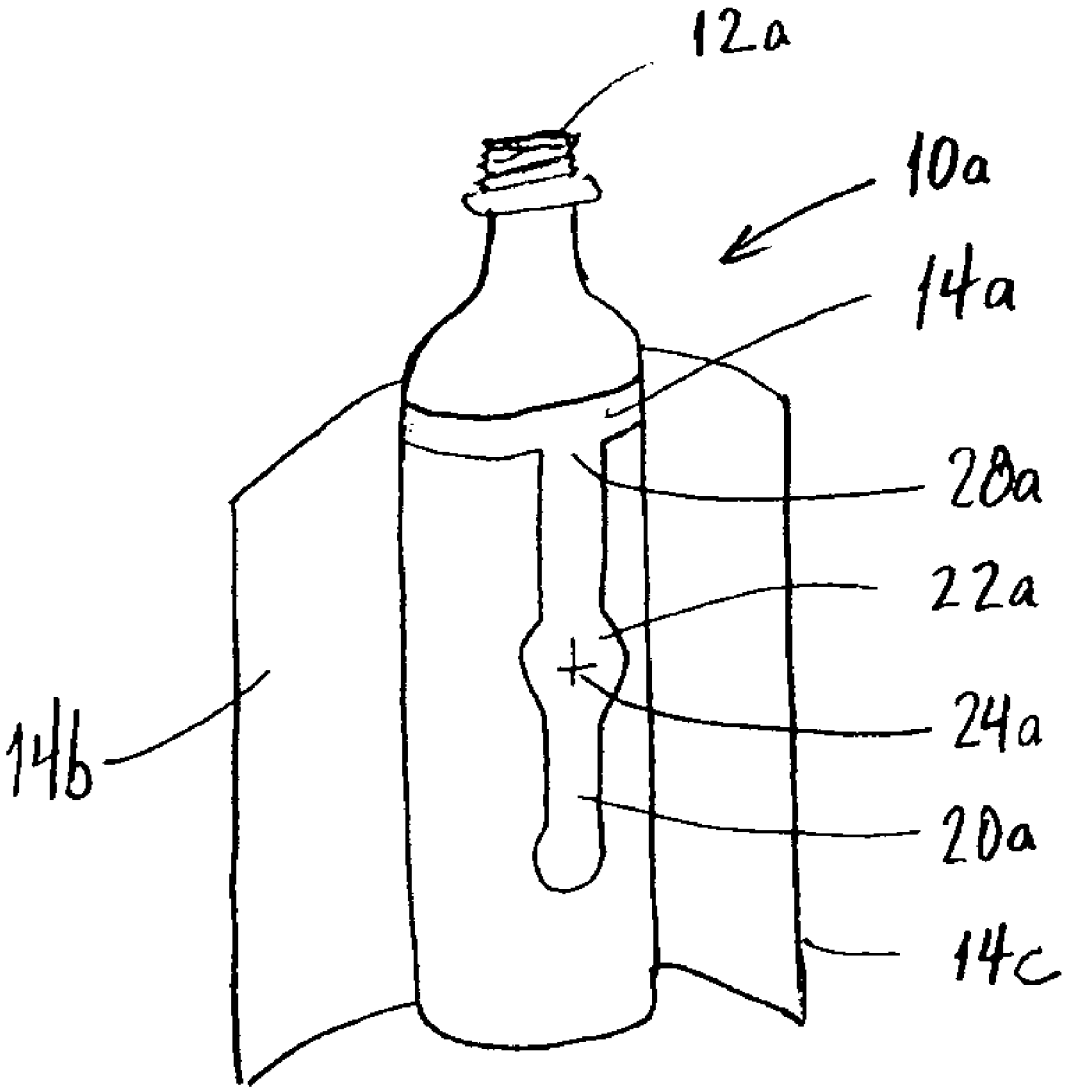
FIG. 1*a* is a side perspective view of a bottle including a straw support according to further embodiment of the present invention.

FIG. 1*a* shows a further embodiment in which a straw holder 20*a* is held onto a bottle by a ring 14*a*. The straw holder 20*a* includes a straw support portion 22*a* with a central aperture 24*a* dimensioned to receive a straw therethrough in an interference fit. A label 14*b* or other protective material covers the straw holder 20*a* until the beverage is ready to be consumed (the label 14*b* is partially removed from the bottle 10*a* in FIG. 1*a*). The label 14*b* protects the straw holder 20*a* from dust and other contaminants to which the bottle may be exposed prior to use. To use the straw holder 20*a*, a user removes the label 14*a* or other protective cover and manipulates the straw holder 20*a* as described above with reference to the straw holder 20 of FIG. 1 so that the straw support portion 22*a* is arranged over the mouth of the bottle. The removal of the label 14*b* may be accomplished by using a perforation or other separable line 14*c* on the label 14*b*. A further label may be arranged under the straw holder 20*a* for aesthetic purposes.

Figure 5:
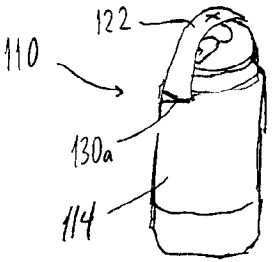
FIG. 5 is a side perspective view showing the rear side of the can of FIG. 4.
Figure 4:
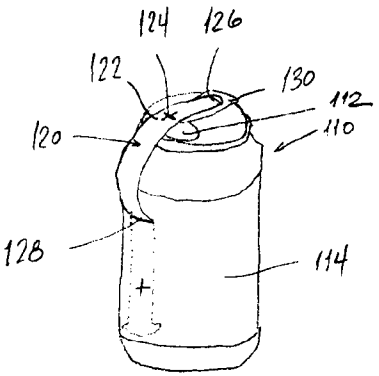
FIG. 4 is a side perspective view of a can incorporating an embodiment of the straw holder according to the present invention.

FIG. 4 shows a further embodiment in which a can 110 has a band 114 made of a film or thin sheet of material wrapped around the can. A straw holder 120 similar to the straw holder 20 in FIGS. 1-3 is brought from a first position against the can to the position shown in FIG. 4 in which a straw support portion 122 with an aperture 124 is brought over a mouth 112 of the can 110. A first end 126 of the straw holder 120 may be arranged as a connecting portion which is insertable in the tab 130 of the can 110, as shown in FIG. 4. Alternatively, the first end 126 may be insertable in a slit 130*a* (FIG. 5) in the band 114 for holding the straw support portion 122 in place. Alternatively, a hole or a slit may be defined in the first end 126 of the straw holder 120 through which the tab 130 of the can 110 fits to hold the straw support portion 122 in place. As a further alternative, the straw support portion 122 may be held in place by the straw itself when the straw is arranged in the mouth of the can 110. As mentioned above, the straw holder 120 should be large enough to completely cover the opening of the bottle. The embodiment of the straw holder 20*a* shown in FIG. 1*a* may also be arranged on the can 110 of FIG. 4.

Figure 7:
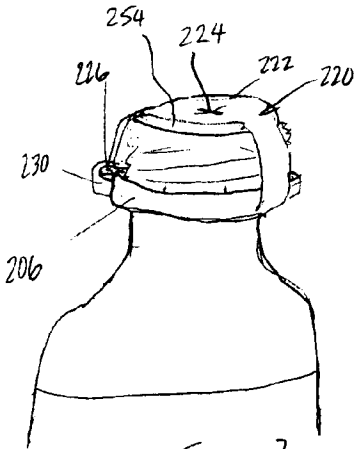
FIG. 7 is a perspective view of the straw holder of FIG. 6 in position for use.
Figure 6:
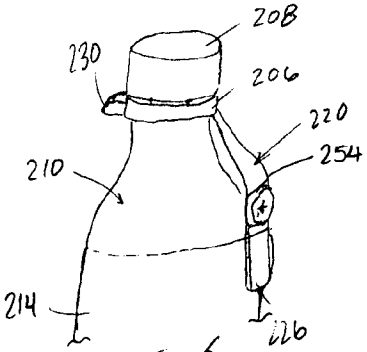
FIG. 6 is a perspective view of a top of a bottle incorporating a further embodiment of the straw holder according to the present invention prior to use.
Figure 8:
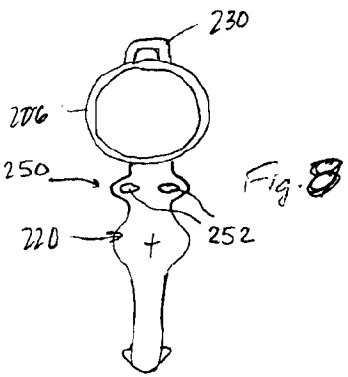
FIG. 8 is a plan view of the straw support of FIG. 6.

According to a further embodiment shown in FIGS. 6-8, a straw holder 220 may be connected to a collar 206 which is formed integrally with a plastic cap 208 of a bottle 210. As is conventional, the plastic cap 208 is separated from the collar 206 when the cap 208 is removed from the bottle 210 and the collar is retained on the bottle 210. In this embodiment, as in the previous embodiment, the straw holder 220 has a straw support portion 222 with an aperture 224 in which the straw is received in an interference fit. The straw itself may hold the straw support portion 222 in the position above the mouth of the bottle. Alternatively, the collar 206 may further include a connector 230 arranged approximately opposite from the portion to which the straw holder is connected and forming a hole in which the end 226 of the straw holder 220 is engagable for holding the straw support portion 222 at the position above the mouth of the bottle 220. Instead of the connector 230 being arranged on the collar 206, the connector may be arranged on the bottle itself. This is possible if the bottle is plastic.

The free end 226 of the straw support portion is held down by a band 214 on the bottle. This allows the straw holder to be placed on the bottle prior to purchase by a consumer while at the same time facilitating transport and handling of the beverage container prior to opening of the mouth. When the consumer desires to drink the beverage and use the straw holder 220, the free end 226 of the straw support portion 222 is removed or withdrawn from the band 214 and the straw support portion 222 is moved to a position in which the aperture 224 is over the mouth of the bottle so that the straw can be inserted through the aperture and into the bottle. In this embodiment, the straw holder 220 further comprises a lip 254 which fits tightly over the bottle opening as shown in FIG. 7. This helps prevent contaminants or insects from entering the bottle.

FIG. 8 is a plan view of the collar 206 with the straw holder 220 and the connector 230 including a further feature. The straw holder 220 of FIG. 8 includes a tie down area 250 having holes for receiving a clip, rope, string or any other device which may be used to hold the bottle. Clips, ropes, and strings are typically used by hikers to carry peripheral equipment such as water bottles.

Figure 9:
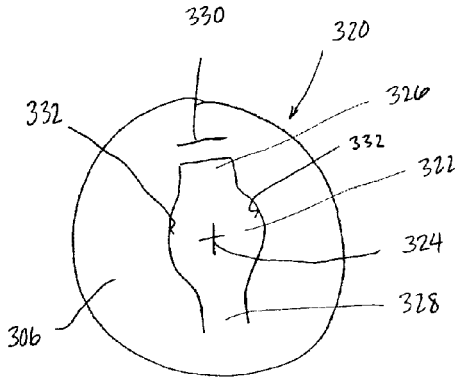
FIG. 9 is a plan view of a straw support according to yet another embodiment of the present invention.
Figure 10:
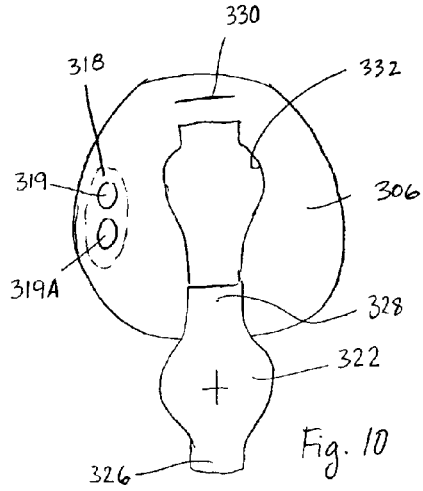
FIG. 10 is a plan view of the straw support of FIG. 9 with straw support portion moved to a further position.

In a further embodiment shown in FIGS. 9-10, a straw holder 320 has a straw support portion 322 connected to a retaining portion 306 by an end 328. The straw support portion 322 folds outward (see FIG. 10) creating a hole in the center of the retaining portion 306. The sides 332 of the hole are spaced to engage a bottle proximate the mouth of the bottle. A slit 330 is arranged on the retaining portion 306 on a side of the hole that is approximately opposite the area of the connection of the end 328 to the retaining portion 306.

A test area 318 is arranged on the straw holder including a material 319 that provides a visual indication of the presence of at least one date rape drug such as, for example, Rohypnol or gamma hydroxy butyrate (GHB). The straw holder 320, which acts as a holder for the material 319 in the test area 318, must be sufficiently porous to allow a drink suspected of containing a date rape drug to flow through the straw holder and reach the material 319 in the test area 318. A further material 319*a* may also be arranged in the test area 318 as an indication for a different type of date rape drug such as, for example, ketamine. The material 319, 319*a* may comprise any of the materials disclosed by U.S. Patent Application Publication Nos. 2004/0146429 and 2003/0044989 and U.S. Pat. No. 6,703,216, the entire contents of which are incorporated herein by reference, or any other known or hereafter developed material or technique which provides a visual indication of the presence of a date rape drug upon exposure to a drink containing the date rape drug. Although two materials 319, 319*a* are shown in each test area 318, one, three or more different materials may be arranged in each test area. The test areas 318 may be applied to any of the embodiments disclosed in the present application and are not limited to the embodiment of FIGS. 9 and 10.

To test for date rape drugs, a drop of the drink is placed in the test area 318 so that the fluid being tested flows into all materials 319, 319*a* in the test area. A change in color of materials 319 or 319*a* indicates the presence of a date rape drug. As shown in FIG. 10, the straw holder 320 may include more than one test area 318 so that the test can be performed more than once. Although two test areas 318 are shown in FIG. 10, three or more test areas may alternatively be arranged on the straw holder 320. Instead of placing drops of ink on the area 318, the area 318 may be removable from the straw holder allowing it to be dipped into the beverage. Further information regarding the use of date rape drugs on a straw holder are detailed in copending U.S. application Ser. No. 11/364,997, filed Mar. 1, 2006, the entire content of which is incorporated herein by reference.

Figure 11:
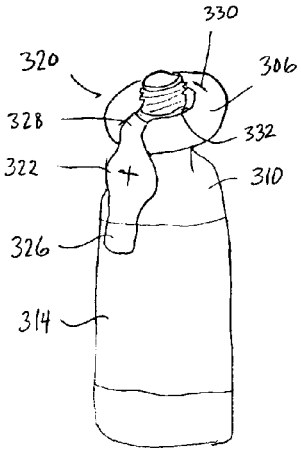
FIG. 11 is a perspective view of a bottle with the straw holder of FIG. 9 mounted thereon.
Figure 12:
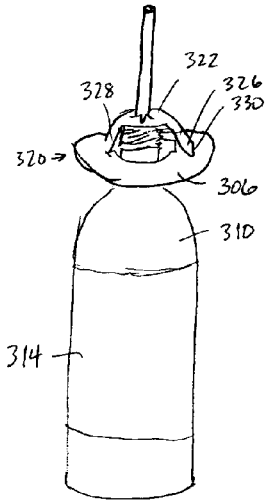
FIG. 12 is a perspective view of a bottle as in FIG. 11 in which the straws holder is positioned for use.

FIG. 11 shows the straw holder 320 arranged on a bottle 310. As depicted, the sides 332 engage the bottle 310 to hold the straw holder thereon. In FIG. 11, the free end 326 of the straw support portion is held down by a label 314 on the bottle. This allows the straw holder to be placed on the bottle prior to purchase by a consumer while at the same time facilitating transport and handling of the beverage container prior to opening of the mouth. When the consumer desires to drink the beverage and use the straw holder 320, the free end 326 of the straw support portion 322 is removed or withdrawn from the label and the straw support portion 322 is moved to a position as shown in FIG. 12 in which the aperture 324 is over the mouth of the bottle so that the straw can be inserted through the aperture and into the bottle. The free end 326 may then be inserted into the slit 330 on the retaining portion 306 to hold the straw support portion 322 over the mouth.

Since the sides 332 of the straw holder 320 shown in FIGS. 11 and 12 form a collar around the neck of the bottle, the straw holder 320 may incorporate an absorbent material (not shown) in the area of the sides 332 for preventing drips after pouring the contents of the bottle. Additional cylindrical collars such as paper sleeves held together by interlocking tabs may also be connected to the straw holder 320 for this purpose. This drip preventing function may be added to any of the embodiments of the present application or parent U.S. application Ser. No. 10/888,681 filed Jul. 9, 2004, the entire contents of which are incorporated herein by reference.

Figure 13:
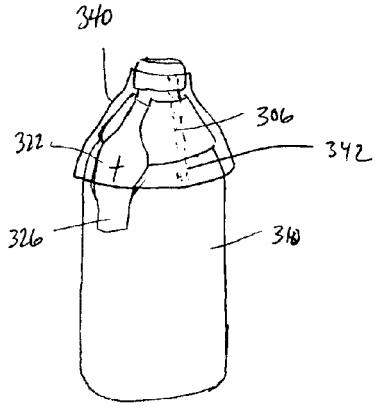
FIG. 13 is a perspective view of a bottle with the straw holder of FIG. 9 with a cover material holding the straw holder against the bottle.

FIG. 13 shows a bottle 310 with the straw holder 320 as in FIG. 11. Instead of using a label to hold the straw holder 320 against the bottle, FIG. 13 discloses a film such as a shrink wrap 340 arranged over the straw support 320 for holding the straw support 320 against the bottle. The shrink wrap may have perforations to facilitate removal of the shrink wrap when consumption of the beverage is desired.

Figure 14:
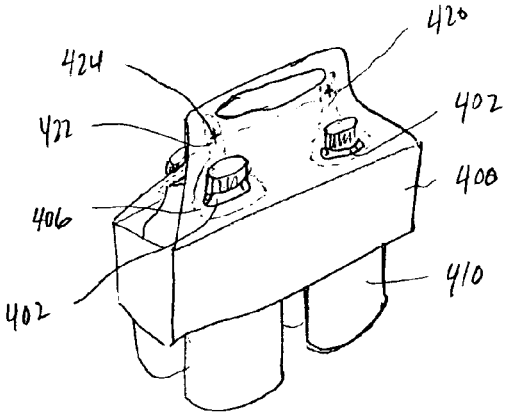
FIG. 14 is a perspective view of a bottle carrier incorporating a straw support according to the present invention.

FIG. 14 shows a further embodiment in which a packaging material such as a carrier 400 includes apertures for receiving the upper ends of the bottles 410. The carrier 400 may be made of plastic and the apertures are sized and dimensioned for engaging the bottles so that the bottles 410 are retained by the carrier 400 when the carrier is lifted. The carrier 400 incorporates a straw holder 420 thereon which is removable from the carrier via, for example, perforations. The straw holder 420 includes a retaining portion 406 surrounding the top of the bottle 410 and a straw support portion 422 which can be manipulated to cover the bottle opening and to prevent contaminants from entering the bottle. The straw support portion 422 includes an aperture 424 for receiving a straw therethrough. The straw holder 420 may take the shape of any of the embodiments previously or hereafter described. Although the straw holder 420 is shown at the location receiving the tops of the bottles, the straw holder may be arranged at any location on the packaging such as, for example, the sides, top or bottom of the packaging.

Figure 14A:
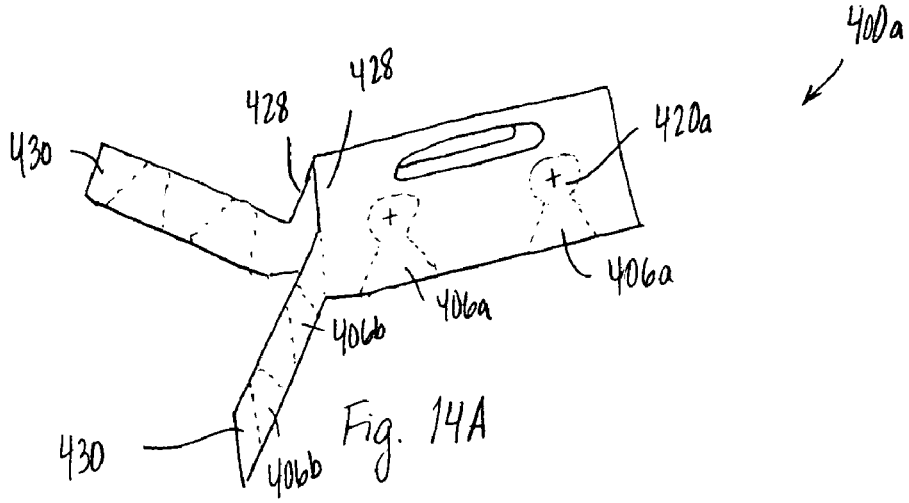
FIGS. 14A, 14B, and 14C are perspective views of a further embodiment of the bottle carrier of FIG. 14.
Figure 14B:
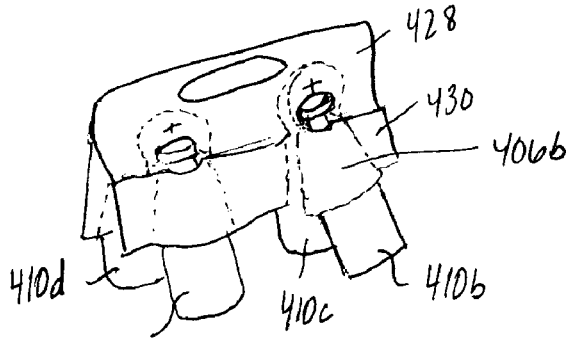
Figure 14C:
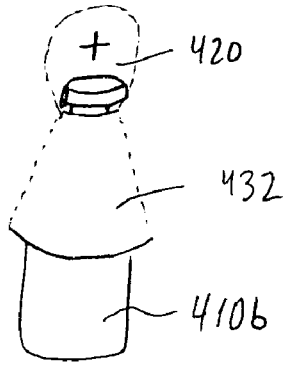

FIGS. 14A, 14B, and 14C disclose a further embodiment of a carrier 400*a*. In this embodiment a panel 430 is folded onto a side 428 of the carrier 400*a*. The panel 430 is connected by a glue, adhesive or other mechanical connection to the side 428 along perforations. Bottles 410*a, b, c, d* are inserted between sections 406*a* of the side 428 and sections 406*b* of the panel 430 as shown in FIG. 14B such that each pair of the sections 406*a*, 406*b* forms a collar 432 around the neck of one of the bottles. The side 428 also includes a straw holder 420*a* connected to the collar 432. The collar 432 can be removed with the bottle by tearing along the perforations. FIG. 14B shows bottle 410*b* in the process of the being removed. FIG. 14C shows bottle 410*b* fully removed. In the fully removed state, the straw holder 420*a* is used similarly to the straw holder 420 described above.

Figure 15:
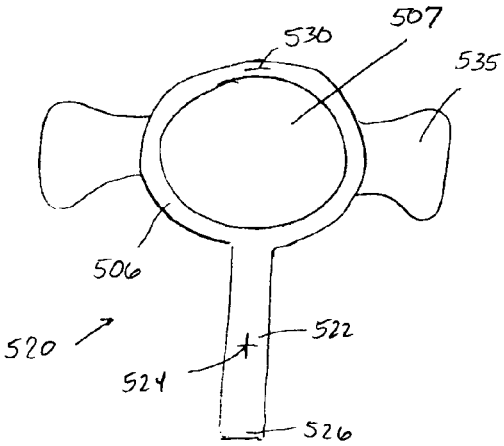
FIG. 15 is a plan view of a straw support for arrangement on a cup.
Figure 16:
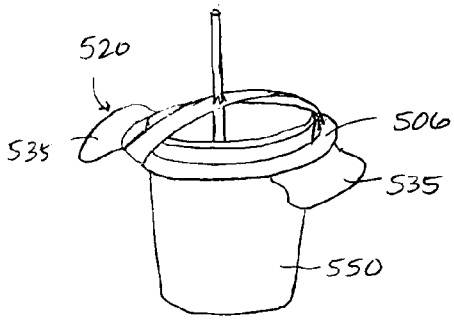
FIG. 16 is a perspective view of the straw support of FIG. 15 arranged on a cup.

FIGS. 15 and 16 disclose a further embodiment comprising a straw holder 520 designed to be received on a cup 550. The straw holder include a retainer ring 506 defining an aperture 507 that is slightly smaller than an circumference of an upper end of a cup 550. The straw holder 520 is fitted onto the cup by passing the ring 506 over the bottom of the cup moving the ring upward until there is an interference fit with the cup. To facilitate this, the retainer ring 506 has wings 535 which are easily grabbed by a user for manipulation of the straw holder 520. The straw support portion 522 is then pivoted over the top of the cup. A free end 526 of the straw holder 520 may be inserted in a slit 530 on the ring to hold the straw holder in place over the cup 550. The straw holder may include more than one straw support portion 522 and associated slit 530, thereby giving a user to hold two straws for sharing a drink and/or providing a backup straw support portion which may be used if a tear or other problem occurs with one of the straw support portions 522.

Figure 17:
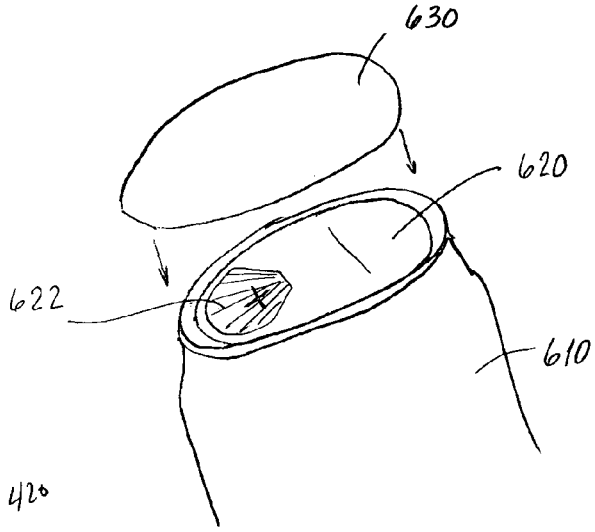
FIG. 17 is a perspective view of a can having a straw support arranged under a cover.

FIG. 17 discloses a can 610 having a straw holder 620 arranged on a top of the can and a cover 630 which is used to cover the straw holder and protect the straw holder 620 from contamination prior to use. The straw holder 620 may be the straw holder disclosed in prior U.S. patent application Ser. No. 11/156,748, filed on Jun. 20, 2005, the entire contents of which are incorporated herein by reference. The straw holder may additionally have a sieve or screen area 622 which allows the contents of the can to flow therethrough while preventing flying insects and other airborne contaminants from falling into or entering the can. The screen area 622 may include slits forming an aperture 624 for receiving a straw through the screen area.

Figure 18:
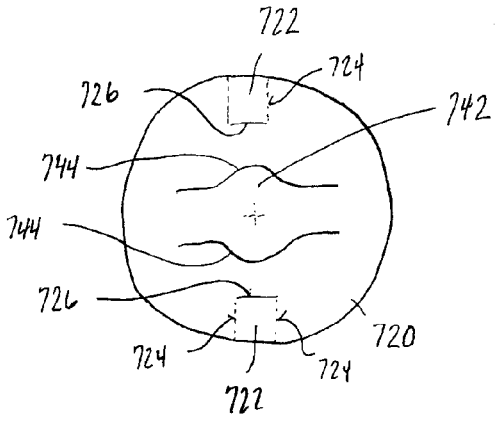
FIG. 18 is a top plan view of another embodiment of a straw support for placement on a cup.
Figure 19:
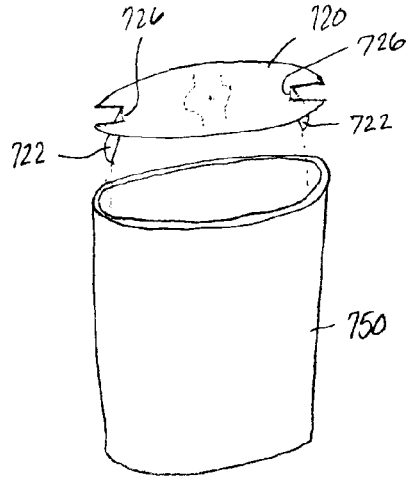
FIG. 19 is a perspective view of the straw support of FIG. 18 in relation to a cup.

FIGS. 18-19 show yet another embodiment comprising a straw holder 720 designed to be received on a cup 750. The straw holder 720 includes tabs 722 arranged on opposing sides of the straw holder 720. Perforations 724 are arranged along the sides of the tabs 722 so that the sides of the tabs can be separated from the remainder of the straw holder and the tabs folded along fold lines 726. The straw holder 720 is then placed on the cup 750 so that the ends of the tabs can be arranged to rest against an inner surface of the cup as shown in FIG. 19. Although only two tabs are shown, the straw holder may comprise three or more tabs 722 to provide greater stability.

The straw holder 720 includes a straw support portion 742 having sides 744 which are defined by perforations. The perforations along the sides may be separated if the straw holder is to be used on a bottle or can as disclosed in U.S. patent Ser. No. 10/888,681, filed Jul. 9, 2004, the entire contents of which are incorporated herein by reference and U.S. patent Ser. No. 11/156,748, filed on Jun. 20, 2005, the entire contents of which are also incorporated herein by reference.

Figure 20:
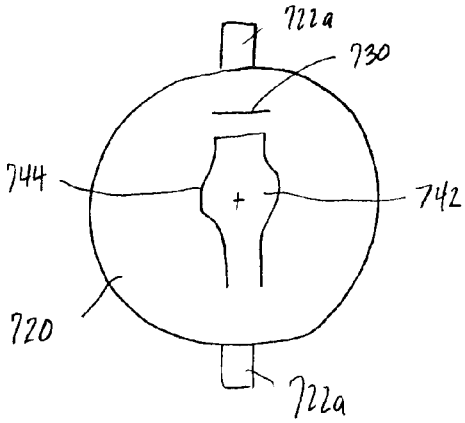
FIG. 20 is a top plan view of another embodiment of a straw support for placement on a cup.
Figure 21A:
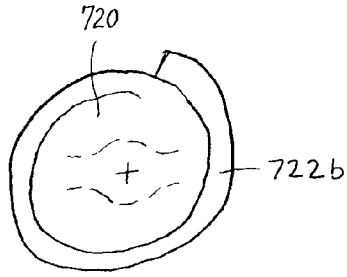
FIGS. 21A and 21B are a top plan view and perspective installed view of another embodiment of a straw support.
Figure 21B:
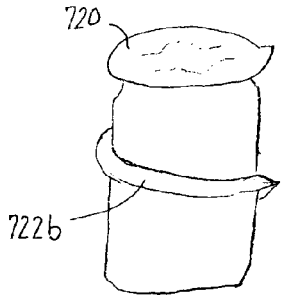

In an alternative embodiment shown in FIG. 20, the straw support portion 742 of FIG. 20 is similar to the straw support portion 322 described above with reference to FIG. 9. Furthermore, the tabs 722*a* in FIG. 20 are arranged so that they protrude radially outward from the periphery of the straw support 720. The straw support of FIG. 20 may additionally or alternatively include tabs 722 from FIG. 18. The inclusion of both tabs 722, 722*a* allows the straw holder 720 to fit a wide range of diameters of cup openings. Similarly, the tabs 722*a* of FIG. 20 may be additionally or alternatively used on the straw holder 720 of FIG. 18. FIGS. 21A and 21B show that the straw holder 720 is provided with a spiral piece 722*a* which may be arranged around a can helically as shown in FIG. 21B to hold the straw holder 720 on top of the can.

Figure 22:
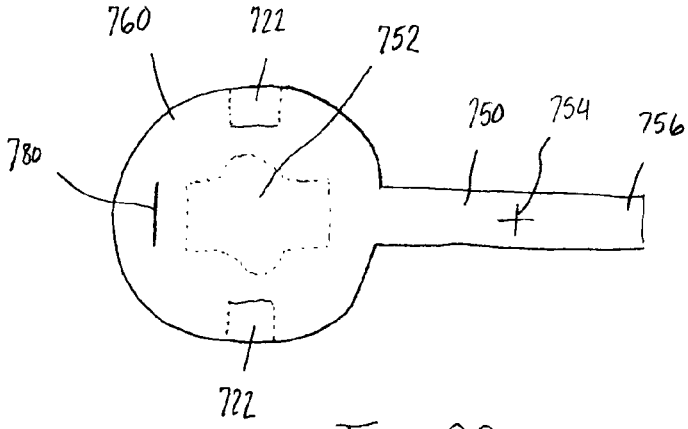
FIG. 22 is a plan view of another embodiment of a straw support/beverage protector according to an embodiment of the invention.

FIG. 22 shows a further embodiment of a straw holder/beverage protector which may be placed on a can, bottle, or cup. The straw holder/beverage protector of FIG. 22 includes a disk-shaped portion 760 having tabs 722 as described above with reference to FIGS. 18 and 19. Accordingly, the disk-shaped portion 760 may be placed on a cup. A section 752 is defined by perforations on the disk-shaped portion 760 and may be removed therefrom by tearing along the perforations. A straw holding portion 750 is a strip connected to the disk-shaped portion 760 and is similar to the straw support portion 522 shown in FIGS. 15 and 16. The straw holding portion 750 includes a free end 756 which may be inserted in a slit 780 on the disk-shaped portion 760 and an aperture 754 for receiving a straw. The embodiment in FIG. 22 may be used as a beverage protector if the section 752 remains thereon. If the section 752 is removed, the embodiment of FIG. 22 may be used as a straw holder. Instead of using tabs 722, an adhesive may be applied to one side of the disk-shaped portion 760 to hold this embodiment onto the beverage container, i.e., a cup, can, or bottle. Furthermore, the section 752 may also include an aperture 754 for receiving a straw so that section 752 may also be a straw support if it is not removed from the straw support/beverage protector. Moreover, the adhesive may be used on any of the embodiments described in the present application to secure the straw holder portion or any other portion over the opening of the beverage container to prevent spillage and/or the introduction of contaminants.

Figure 23A:
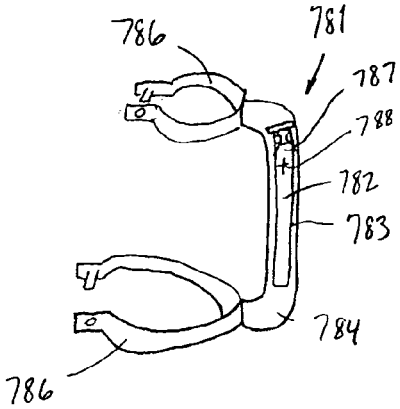
FIGS. 23A and 23B are perspective views of an embodiment of a straw support having a slidable straw support portion.
Figure 23B:
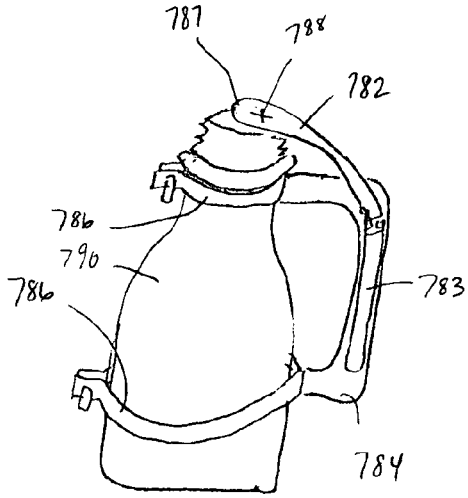

FIGS. 23A and 23B show a further embodiment including a handle 781 which has upper and lower straps 786 for connection to the beverage container 790. The straps 786 may include snap-fit connections as shown in FIGS. 23A and 23B or any other releasable connection so that the handle may be disconnected and reused for another beverage container. Alternatively, the straps 786 may be elastic rings through which the beverage container is inserted. In FIGS. 23A and 23B, the straps 786 include a small upper strap and a larger lower strap. However, the straps 786 may be of equal size to fit a can or the lower strap may be smaller than the upper strap to fit a cup, for example. A handle portion 784 is connected between the two straps 786 which includes a track 783 and a straw holder portion 782 which slides in the track 783. A leading end 787 of the straw holder portion 782 exits the track as the straw holder portion 782 is moved upward. The straw holder portion 782 includes an aperture 788 for receiving a straw. To use this embodiment, the straps 786 are connected to a container 790, and the straw holder portions is moved out of the track 783, i.e., by a user's thumb, until the aperture 788 is aligned with the container opening. After it is used, the straw holder portion 782 may be retracted back into the track 783 and the handle 781 removed from the container 790 to be used again.

Figure 24:
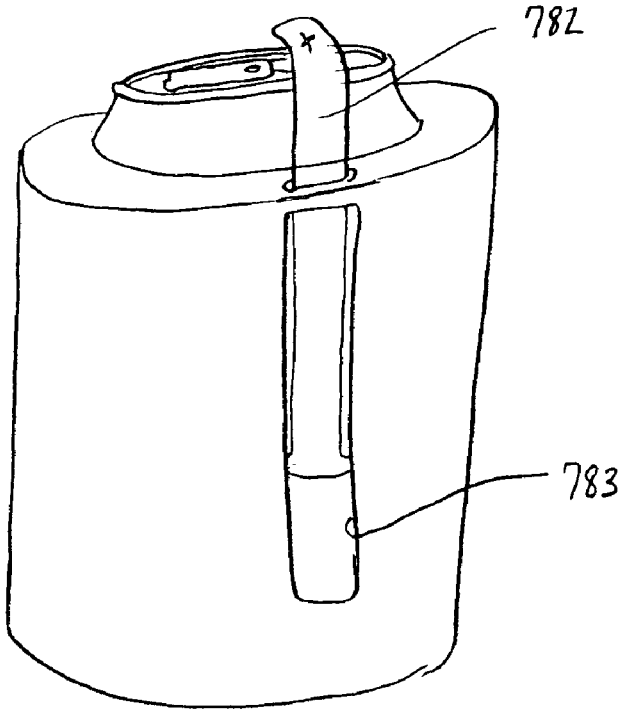
FIG. 24 is a perspective view of another embodiment of a straw support having a slidable straw support portion.
Figure 24A:
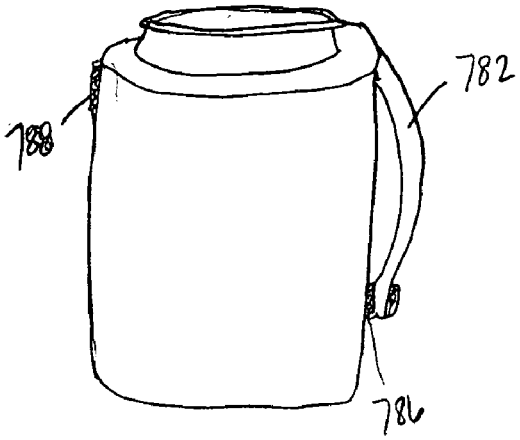
FIGS. 24A and 24B are perspective views of a further embodiment of a cup holder with a straw support.
Figure 24B:
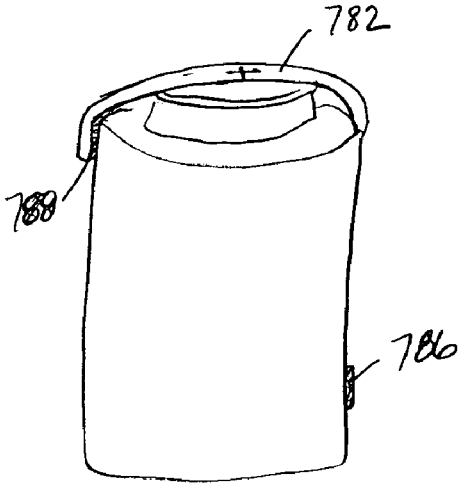

The track 783 and straw holder portion 782 of FIGS. 23A and 23B may be incorporated into a coozie or other substantially cylindrical insulated holder for beverage containers, as shown in FIG. 24. Furthermore, the straw holder portion 782 may be connectable by a Velcro connection 786, 788 or other releasable connection to the holder in a storage position FIG. 24A and a drinking position FIG. 24B in which the straw holder portion 782 is arranged over the top of the can or bottle held by the holder.

Figure 25:
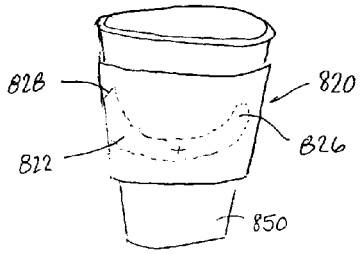
FIGS. 25 and 26 are perspective views of a cup holder having a straw support.
Figure 26:
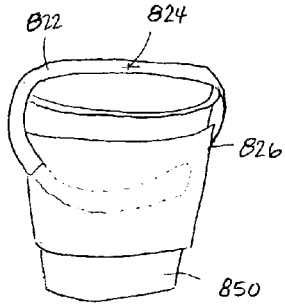
Figure 27A:
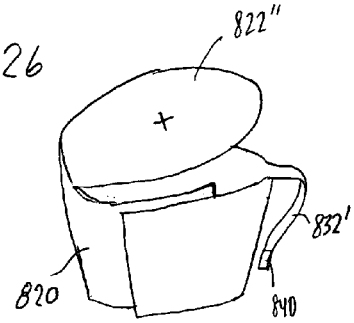
FIG. 27A is a perspective view of a further embodiment of the cup holder of FIG. 27.
Figure 27:
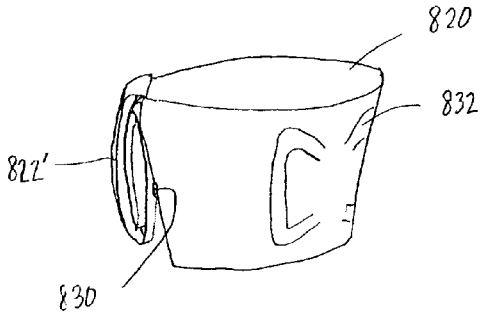
FIG. 27 is a perspective view of a further embodiment of a cup holder having a straw support arranged thereon.

FIGS. 25 and 26 show a straw holder 820 in the form of a cup holder. Perforations in the cup holder define a straw holder portion 822. A first end 826 is removable by separating the straw holder 822 along the perforations. A second end is 828 is not connected by perforation. The straw holder portion 822 thus remains connected to the cup holder via the second end 828. As described above, the straw holder portion 822 is positionable so that a central aperture 24 dimensioned to receive a straw therethrough in an interference fit is arranged over the top of the cup. The first end 826 may be inserted in a slit (not shown) as described above to hold the straw holder portion in its operable position. Instead of being connected to the cup holder via perforations, the straw holder portion 822 may be connected as is the straw holder portion 522 shown in FIG. 15. In this case, the straw holder portion 822' may be folded or rolled and secured to the side of cup holder by, for example, a spot of adhesive or glue 830 as shown in FIG. 27. When desired, the user can release the straw holder portion 822' from the cup holder and unfold it for use. As also shown in FIG. 27, the cup holder 820 may have handles 832, as is conventional. Instead of the handles shown in FIG. 27, the handles may comprise loops 832' of material having ends which are connected to the cup holder via adhesive or glue 840 as shown in FIG. 27A. Furthermore, the straw holder portion 822' of FIG. 27 may alternatively comprise a lid 822" as shown in FIG. 27 A which entirely covers the cup which is received in the sleeve 820.

Figure 28:
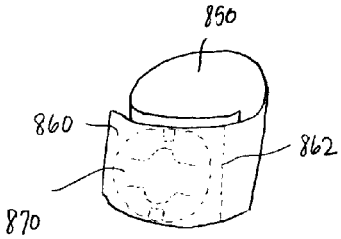
FIGS. 28 and 29 are perspective views of a further embodiment of a cup holder with a straw support/beverage protector detachably arranged thereon.
Figure 29:
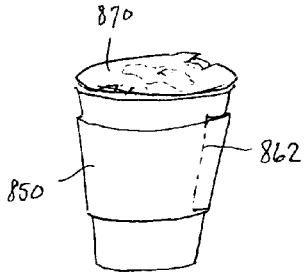

FIGS. 28 and 29 show a cup holder 850 having a tear-away portion 860 connected to the remainder of the cup holder along a perforated tear line 862. The tear away portion 860 includes a straw holder/beverage protector 870. Upon removal of the straw holder/beverage protector 870 from the cup holder 850, the straw holder/beverage protector may be placed on the cup as shown in FIG. 29. The straw holder/beverage protector 870 may take the form of any of the previously described embodiments applicable to cups such as FIGS. 15, 16, 18, and 19. Alternatively, the straw holder/beverage protector may also be of the type that is applicable to cans or bottles as described herein. According to an alternative embodiment, the perforated tear line 862 does not extend all the way across the cup holder 850 so that the straw holder/beverage protector 870 remains connected to the cup holder 850. In this alternative embodiment, the holder/beverage protector 870 is folded over the top of the cup being held by the cup holder 850. The holder/beverage protector 870 may include an end which can be inserted in a slit such as the end 26 and slit 30 shown in the embodiment of FIG. 3.

In each of the embodiments of cup holders, the cup holder may comprise a hot beverage sleeve, such as java jackets used for coffee cups, or a chill sleeve for cold beverages. Furthermore, the material may comprise any material known or hereafter developed for such purpose, such as a biodegradable insulating material or a laminate of materials such as paper and insulating materials. The latter may be used in application where an advertisement or other information is to be displayed on the cup holder. Instead of or in addition to being tapered, the cup holders may have closed bottoms or at least a support portion at a bottom thereof for retaining a non-tapered beverage holder such as a bottle or can therein.

Instead of being arranged on a cup holder, the straw holder/beverage protector 870 may be attached to other objects such as, for example matchbooks, coasters, menus, and restaurant place mats, or any other objects that the straw holder/beverage protector 870 is placeable on or releasably connectable to, so that straw holder/beverage protector 870 is readily available to a user when required.

Figure 30:
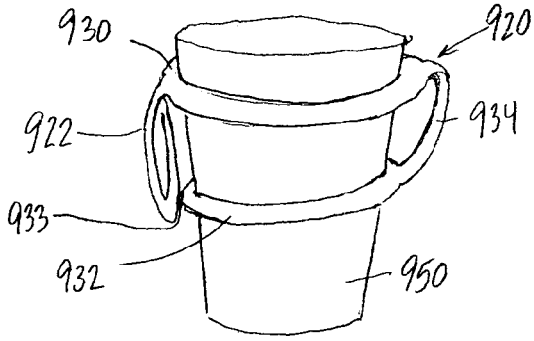
FIGS. 30 and 31 are perspective views of further cup holders with straw supports arranged thereon.
Figure 31:
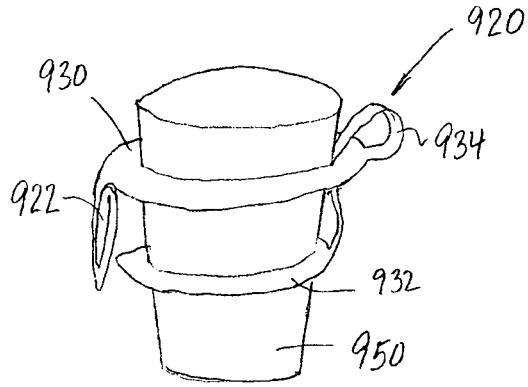

FIGS. 30 and 31 show an alternative cup holder 920 with a straw holding portion 922 for a cup 950. The cup holder 920 includes two rings 930, 932, wherein the second ring 932 is smaller than the first ring 930. A connecting strip 934 connects the two loops and may be arranged as shown in FIGS. 30 and 31. The straw holding portion 922 is similar to the straw holder 822' described above. The straw holding portion 922 may be held onto the second ring 932 by a spot of glue or adhesive to keep the straw holding portion clear during insertion of the cup 950 in the cup holder 920. Instead of being folded, the straw holding portion 922 may just be connected as a strip to the first ring 930 similar to the attachment of straw holding portion 522 to ring 506 in the embodiment of FIGS. 15-16.

Figure 32:
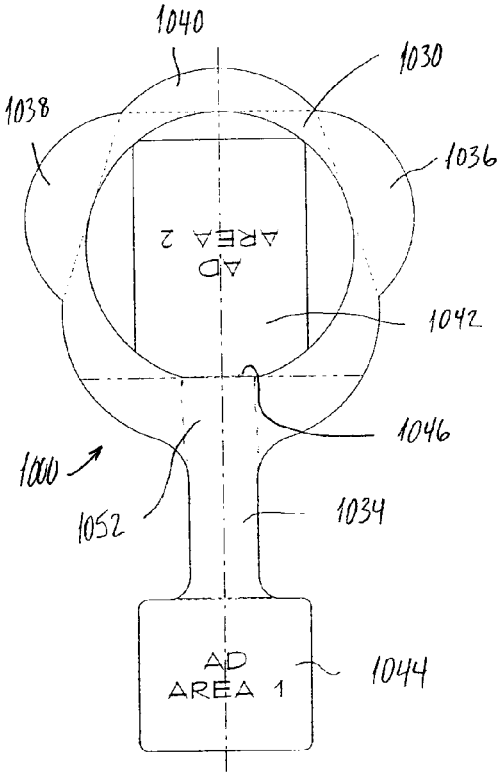
FIG. 32 is a top plan view of yet another embodiment of a cup holder made from a sheet of material.
Figure 33:
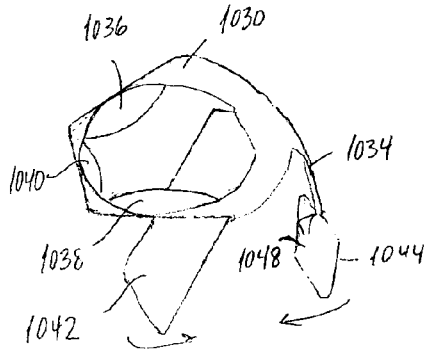
FIG. 33 is a perspective view of the cup holder of FIG. 32 at an intermediate stage being folded for use.
Figure 34:
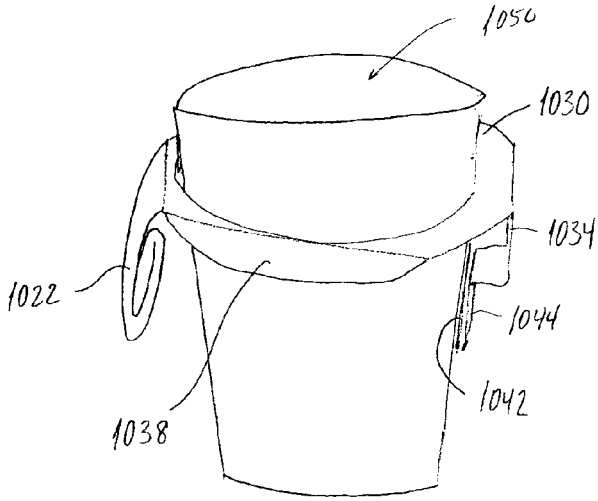
FIG. 34 is a perspective view of the cup holder of FIG. 32 arranged on a cup.

FIG. 32 is a top plan view of a cup holder 1000 according to a further embodiment of the invention. The cup holder 1000 is made from a sheet of material such as paper, cardboard, or plastic, such as polyurethane. The cup holder 1000 includes a ring 1030 connected to one end of a strip 1034. An enlarged first ad area 1044 is arranged at the other end of the strip 1034. A second ad area 1042 is connected to an inner edge of the ring 1030 at a hinge or folding line 1046. foldable tabs 1036, 1038, and 1040 are arranged circumferentially distributed on the ring 1030. These tabs 1036, 1038, 1040 may be folded under the ring 1030 as shown in FIG. 33. Alternatively, they may be folded over the ring 1030. The ad areas 1042 and 1044 are folded downward in preparation for use as a cup holder, the ad area 1044 being glued or otherwise connected to the bottom of the ad area 1044. For this purpose, a protective layer 1048 may be arranged on the side of ad area 1044 facing ad area 1042, wherein the protective layer 1048 is removed to uncover an adhesive which is used to hold the two areas together to form a cup holder handle as shown in FIG. 34. The cup is received through the top of ring 1030. For increased strength, a reinforcing layer 1052 may be arranged on the strip 1034 and on the portion of the ring adjacent the strip 1034. The reinforcing layer may comprise the same material as the sheet or may comprise styrofoam or some other plastic foam. Thus, the reinforcing layer 1052 may also function as a thermal insulator which can be arranged between the user's hand and the cup. Lastly, a straw holding portion 1022 may be arranged on the ring 1030 instead of the tab 1040 as shown in FIG. 27. The straw holding portion may be similar to the straw holding portion 522 described above and shown in FIGS. 15-16.

Figure 35:
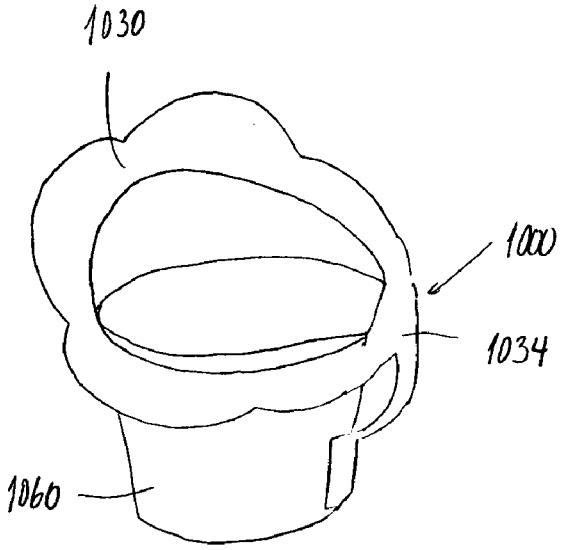
FIG. 35 is a perspective view of a cup holder of FIG. 32 arranged with a cup sleeve.

In a further alternative shown in FIG. 35, the cup holder 1000 is combined with a cup sleeve 1060 such as a coffee cup sleeve or a cold beverage sleeve. In this embodiment, a straw holder may be attached to the ring 1030 as in FIG. 34. Alternatively, the ring 1030 may be left off so that only the strip 1034 connects the sleeve 1060 to the ad area 1044. In the latter case, a straw holder may be incorporated with or attached to the cup sleeve 1060 using any of the above described means in FIGS. 25-29.

Figure 36:
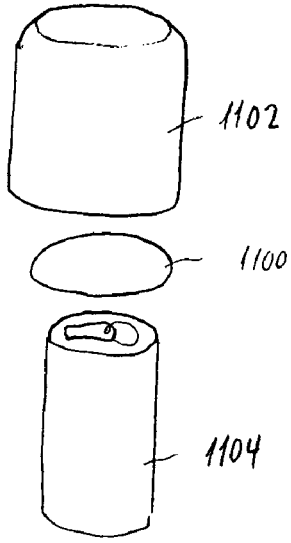
FIGS. 36-37 are exploded and sectional views of a further embodiment in which a straw support is packaged with a can and a cup.
Figure 37:
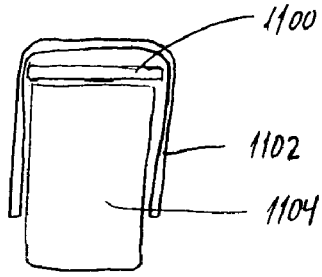

FIGS. 36-37 show yet another embodiment in which a straw holder/beverage protector 1100 is packaged with a can 1104 and a cup 1102. The straw holder/beverage protector 1100 may comprise any of the disk-shaped straw holders/beverage protectors previously disclosed in described with respect to FIGS. 17-22 of the present application or the disk-shaped straw holders/beverage protectors disclosed in U.S. application Ser. Nos. 10/888,681 and 10/684,882, which are incorporated herein by reference. Accordingly, a CD or other promotional object may be mounted on the straw holder/beverage protector 1100. The straw holder/beverage protector may be held onto the can with an adhesive so that it is not removed with the cup when the cup is removed from the can. Alternatively, the straw holder/beverage protector 1100 may be held onto the can by the pop-top tab or some other projection on the can designed for this purpose. The straw holder/beverage protector may be designed to be used with the cup, the can, or both.

Figure 38:
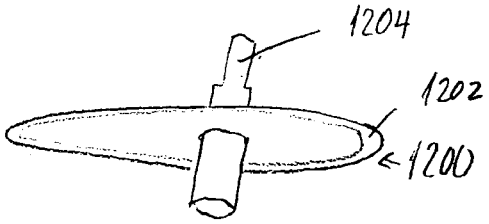
FIG. 38 is a perspective view of an embodiment of a straw support having a straw extender.

In yet another embodiment shown in FIG. 38, the straw holder/beverage protector 1100 includes a ring of adhesive designed to meet the rim of a container. In addition, a straw extender 1204 is connected to the straw holder/beverage protector to allow a straw to be used, for example, in a long bottle. The ring of adhesive may be sized for the appropriate container.

Figure 39:
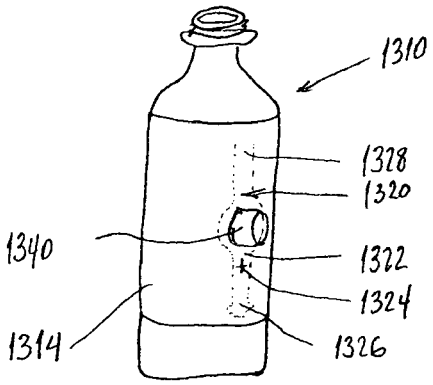
FIGS. 39 and 40 are side views of a straw support having a separate container cover arranged thereon.
Figure 40:
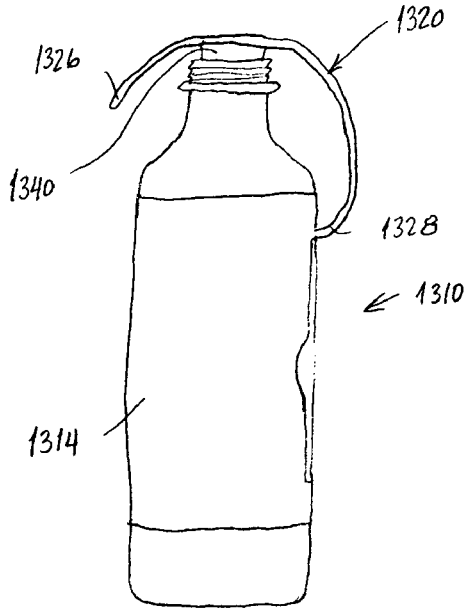

FIGS. 39-40 show another embodiment similar to that disclosed in FIG. 1 in which a bottle 1310 incorporates a straw holder/beverage protector 1320. The bottle includes a band 1314 made of a thin film wrapped around the bottle such as, for example, a label on the bottle with perforations that define the straw holder/beverage protector 1320 on the label. The straw holder/beverage protector 1320 includes a straw support portion 1322, an aperture 1324 dimensioned to receive a straw in an interference fit, a first end 1326 and a second end 1328. The aperture 1324 may be the type defined above with respect to FIG. 1. A cover element 1340 is attached to the straw holder/beverage protector 1320. As in the embodiment of FIG. 1, the first end 1326 and the straw support portion 1322 are separated from the label and the second end remains connected. According to this embodiment, a user may utilize the aperture 1324 to hold a straw for drinking the beverage and then may use the cover element 1340 to cover the mouth of the bottle to protect any remaining beverage for subsequent or later consumption. In the drawings, the cover element is shown as a stopper which fits with an interference fit into the opening of the container. However, the cover element may simply comprise a portion of the straw holder/beverage protector that covers the opening of the container. Furthermore, the cover may have an adhesive such as the adhesive used in the embodiment of FIG. 38 described above to hold the cover on the opening.

Figure 41:
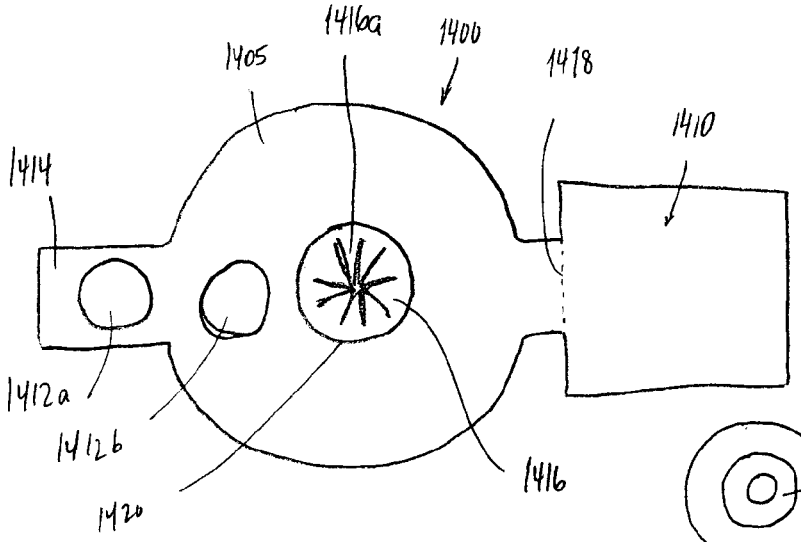
FIGS. 41 and 42 are a top view and perspective view of a drip-preventing disk according to another embodiment of the present invention.
Figure 42A:
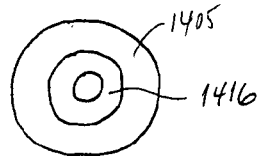
FIG. 42A is a top view of a drip preventing disk according to a further embodiment.
Figure 42:
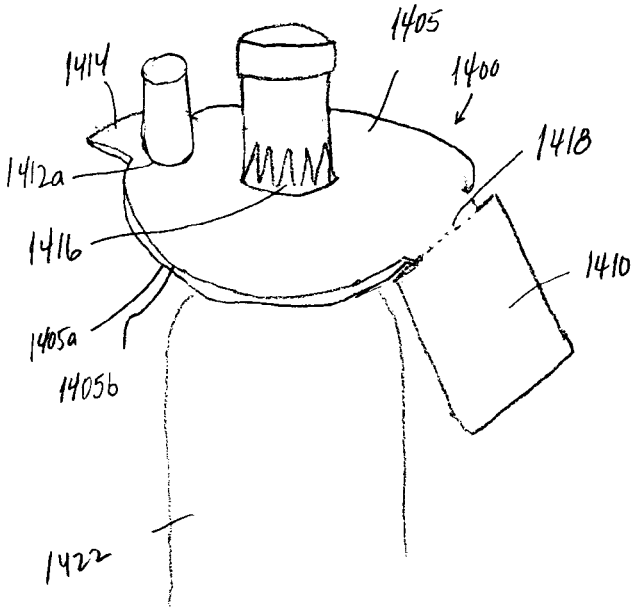

FIGS. 41 and 42 disclose a further embodiment comprising a drip-preventing disk 1400 having a disk portion 1405 with a central hole 1420 arranged for insertion over the top, i.e., mouth, of a wine bottle 1422. A layer of absorbent material 1416 is arranged between two support layers 1405*a*, 1405*b*. The support layers are made from paper, for example, and may be connected at a folding line so that one layer is folded over the other. The absorbent material 1416 is cut into pie-slice sections 1416*a* in the area of hole 1420 allowing the neck of the wine bottle to be inserted therethrough without tearing the absorbent material 1416. The absorbent material 1416 may comprise paper towel material, a sponge, or any other know or hereafter developed absorbent material. Instead of having pie-slice sections 1416*a*, the absorbent material 1416 may alternatively have a hole 1416*b* through which the bottle neck is inserted. In this alternative embodiment, the absorbent material is stretchable and completely surrounds the bottle neck, thereby preventing any drips passing the absorbent material 1416.

The drip preventing disk 1400 has a tab 1414 on the left side of FIG. 41 with a cork receiving hole 1412*a* (see FIG. 42). This provides a location for holding the cork instead of resting the cork on the table. As shown in FIG. 41, a cork receiving hole 1412*b* may alternatively or additionally be arranged in the area of the disk portion 1405, in which case the tab 1414 is not necessary. Instead of holding a cork, the hole 1412*a* may hold any cap or cover of the bottle 1422. Furthermore, the test areas 318 disclosed in FIGS. 9 and 10 for testing the presence of date rape drugs may be applied to the tab 1414 or another portion of the drip preventing disk 1400 of FIG. 41.

An ad area 1410 is connected to the disk 1400 by a perforations 1418 for ease of removal. The ad area 1410 may be used to display a label of the wine in the bottle. If the wine enthusiast enjoys the wine, the label may be removed and saved as a reminder for future purchases. Alternatively, the ad area 1410 may display coupons or advertisements for other goods related to or not related to the wine. For example, if the wine is bought in a restaurant or a store, the ad area 1410 may advertise specials or present a coupon related to the restaurant or the store.

Figure 43:
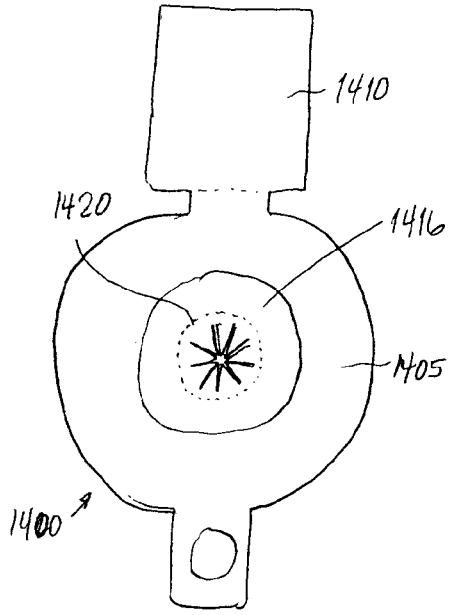
FIG. 43 is a bottom view of a drip-preventing disk according to another embodiment of the present invention.

FIG. 43 shows the bottom of a further embodiment in which the drip-preventing disk 1400 includes only one support layer. In this embodiment, the absorbent material 1416 is attached to the bottom side of the disk portion 1405 in an area surrounding the hole 1420, for example, using an adhesive.

The embodiments of FIGS. 41-43 may be placed on a bottle as shown in FIG. 42 and sold ready to use. Alternatively, the drip-preventing disk 1400 may be detachably connected to the sides of the wine bottle and removed by a user prior to opening the bottle. The detachable connection may be by an adhesive or by removable shrink wrap, for example. As a further alternative, the drip-preventing disk 1400 could be part of a label such as the label shown in FIGS. 1-3. In this case, the drip-preventing disk 1400 could be removed and brought over the top of the wine bottle similarly to the way that the straw holder 20 in FIGS. 1-3 is manipulated.

Figure 44:
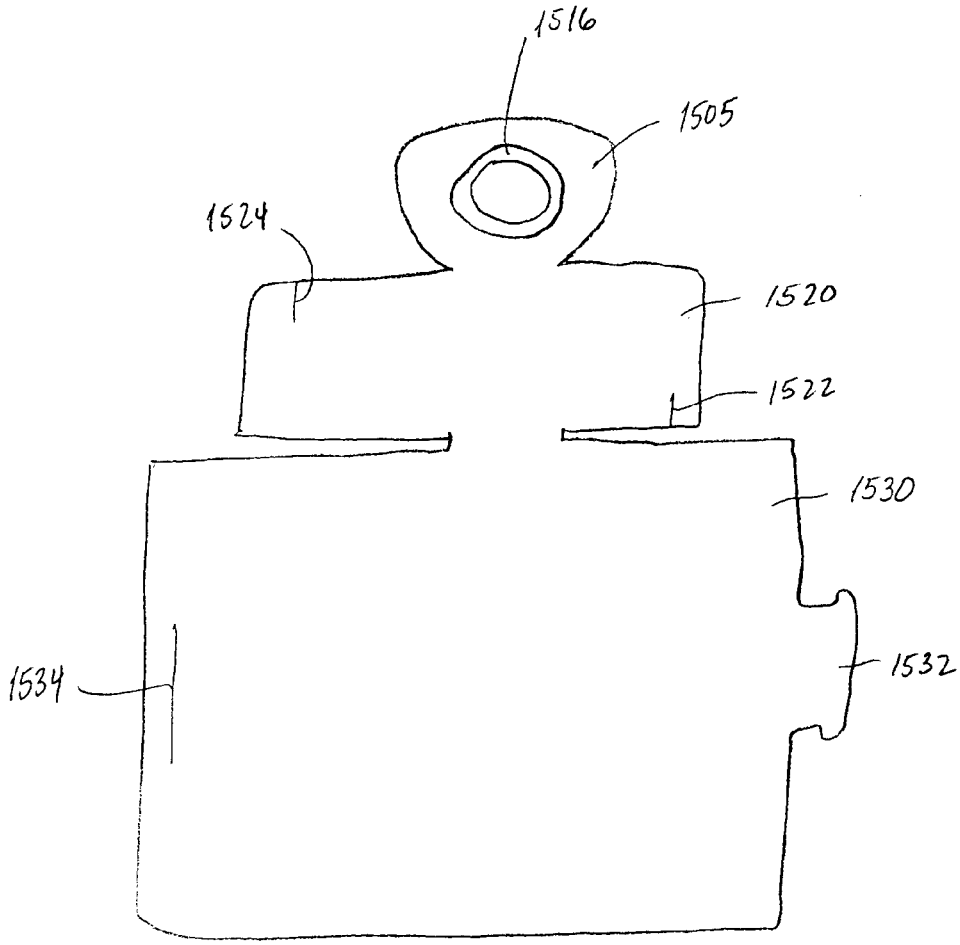
FIG. 44 is a plan view of a drip-preventing disk according to yet another embodiment.
Figure 45:
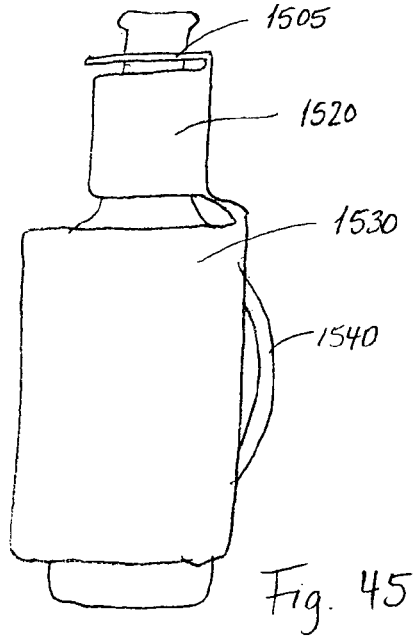
FIG. 45 is a view of the drip-preventing disk of FIG. 44 arranged on a bottle.

FIGS. 44 and 45 show a further embodiment in which a disk portion 1505 is connected to a neck-covering portion 1520 and a bottle covering portion 1530, both of which may be used as an ad space. The disk portion 1505 includes the absorbent material 1516 such as the absorbent material 1416 described above with respect to FIGS. 41-43 and fits over the top of the bottle (see FIG. 45). The neck-covering portion 1520 fits around the neck of the bottle and is held on by interlocking slits 1522, 1524, for example. Similarly, the bottle covering portion 1530 fits around the large portion of the bottle and includes an interlocking tab 1532 and slit 1534. Alternatively, the neck-covering portion 1520 and bottle covering portion 1530 could be held onto the bottle by other attachments such as a Velcro attachment. When such an attachment is used, the bottle covering portion may include a handle 1540.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. For example, the specific form of the straw support of one embodiment may be interchanged with any other forms of the straw support in the other embodiments. Likewise, the specific form of the retaining portion in one embodiment of the straw holder may be interchanged with any of the forms of the retaining portion in the other embodiments. It is the intention, therefore, to be limited only as indicated by the scope of the claims appended hereto.

What is claimed is:

1. In a beverage container having a mouth, the improvement including a straw holder comprising:

a straw support portion dimensioned for placement across the mouth of the container and comprising an aperture designed to receive a straw therethrough and support the straw with respect to said straw support portion; and a first retaining portion connected to said straw support portion and connected or connectable to the container, the straw support portion being movably arranged on said first retaining portion for moving from a first position to a second position relative to said first retaining portion, wherein said aperture for receiving the straw is aligned with the mouth of the container in at least one of said first and second positions when the first retaining portion is connected on the container, wherein a band separate from the container is wrapped at least partially around the container, the first retaining portion being at least one of connected to said band and a part of said band, wherein said band is made of a film or thin sheet of material wrapped around the container, and perforations in said band define the straw holder prior to use of the straw holder, the straw holder being against the side of the bottle in said first position by said band.

2. The straw holder of claim 1, further comprising a second retaining portion connected to one of the container and the straw holder, said straw support portion having a free end connectable to said second retaining portion for holding said straw support portion in the second position.

3. The straw holder of claim 1, wherein said band comprises a label.

4. The straw holder of claim 1, further comprising a second retaining portion arranged on said band, said straw support portion having a free end connectable to said second retaining portion for holding said straw support portion in the second position.

5. The straw holder of claim 1, wherein said straw support portion is arranged at a position proximate a side of the beverage container in said first position, thereby allowing transport and handling of the beverage container prior to opening of the mouth, and said straw support portion being arranged proximate said mouth in said second position so that the straw holder vertically supports a straw through the aperture and in the mouth of the beverage container.

6. In a beverage container having a mouth, the improvement including a straw holder comprising:

a straw support portion dimensioned for placement across the mouth of the container and comprising an aperture designed to receive a straw therethrough and support the straw with respect to said straw support portion; and a first retaining portion connected to said straw support portion and connected or connectable to the container, the straw support portion being movably arranged on said first retaining portion for moving from a first position to a second position relative to said first retaining portion, wherein said aperture for receiving the straw is aligned with the mouth of the container in at least one of said first and second positions when the first retaining portion is connected on the container, wherein a band separate from the container is wrapped at least partially around the container, the first retaining portion being at least one of connected to said band and a part of said band, said straw support portion having a free end connectable to a tab on the container for holding said straw support portion in the second position.

7. The straw holder of claim 6, wherein said band is made of a film or thin sheet of material wrapped around the container, and perforations in said band define the straw holder prior to use of the straw holder, the straw holder being against the side of the bottle in said first position by said band.

8. The straw holder of claim 1, wherein the straw support portion includes a first end and a second end, said first end being separable from said band along said perforations so that said straw support portion can be moved from said first position to said second position, said second end being retained on said band.

9. The straw holder of claim 8, wherein the first end is moved from the side of the bottle over the top of the mouth and to a second retaining portion arranged at a position opposing said second end when said straw support portion is in said second position, said second retaining portion being engagable with said first end to retain said straw holder in said second position.

10. The straw holder of claim 8, wherein said second end is arranged above said first end when said straw holder is in said first position.

11. The straw holder of claim 1, wherein the container is a bottle.

12. The straw holder of claim 11, wherein the band is a label for the bottle.

* * * * *